US005340347A

United States Patent [19]

Yenerich

[11] Patent Number: 5,340,347

[45] Date of Patent: Aug. 23, 1994

[54] FLYING TOY

[76] Inventor: Philip C. Yenerich, 37762 Los Arboles Dr., Fremont, Calif. 94536

[21] Appl. No.: 532,118

[22] Filed: May 31, 1990

Related U.S. Application Data

[63] Continuation-in-part of Ser. No. 210,832, Jun. 24, 1988, abandoned.

[51] Int. Cl.[5] ..... A63H 27/00

[52] U.S. Cl. ..... 446/48; 273/426

[58] Field of Search ..... 446/48, 46, 47; 273/425, 424, 428, 426; D21/85, 86

[56] References Cited

U.S. PATENT DOCUMENTS

| | | | |
|---|---|---|---|
| D. 214,577 | 7/1969 | Mueller | 446/48 X |
| D. 241,565 | 9/1976 | Molenaar | 446/48 X |
| 3,082,572 | 3/1963 | Knox, Jr. | 446/48 |
| 3,673,732 | 7/1972 | Liotta | 446/46 |
| 3,742,643 | 7/1973 | Keith | 446/46 |
| 4,063,382 | 12/1977 | McCallum | 446/48 |
| 4,337,950 | 7/1982 | Gidge | 273/426 |
| 4,479,655 | 10/1984 | Adler | 273/425 |
| 4,506,894 | 3/1985 | Laux et al. | 273/425 |
| 4,591,164 | 5/1986 | Blight | 273/425 |

*Primary Examiner*—Mickey Yu

*Attorney, Agent, or Firm*—James E. Eakin

[57] ABSTRACT

A flying toy comprising a plurality of radial and transverse airfoils integrally formed with and spaced among a plurality of arcuate segments. The radial airfoils generally point inward but are disposed apart from one another. In at least some embodiments the space between the inner surfaces of the airfoils is left open, while in other embodiments a disk is disposed in the space between the inner surfaces of the airfoils but at a point slightly below the lowest edge of the airfoils. The arrangement of radial and rotational airfoils and arcuate segments permits the flight toy to be thrown in the air by a user along a substantially straight path relative to the ground, but with increasing altitude, and to return to the thrower along substantially the same path.

13 Claims, 6 Drawing Sheets

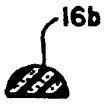
FIG. 4
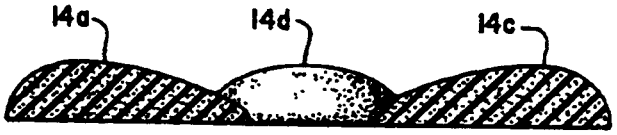
FIG. 5
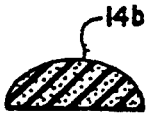
FIG. 6
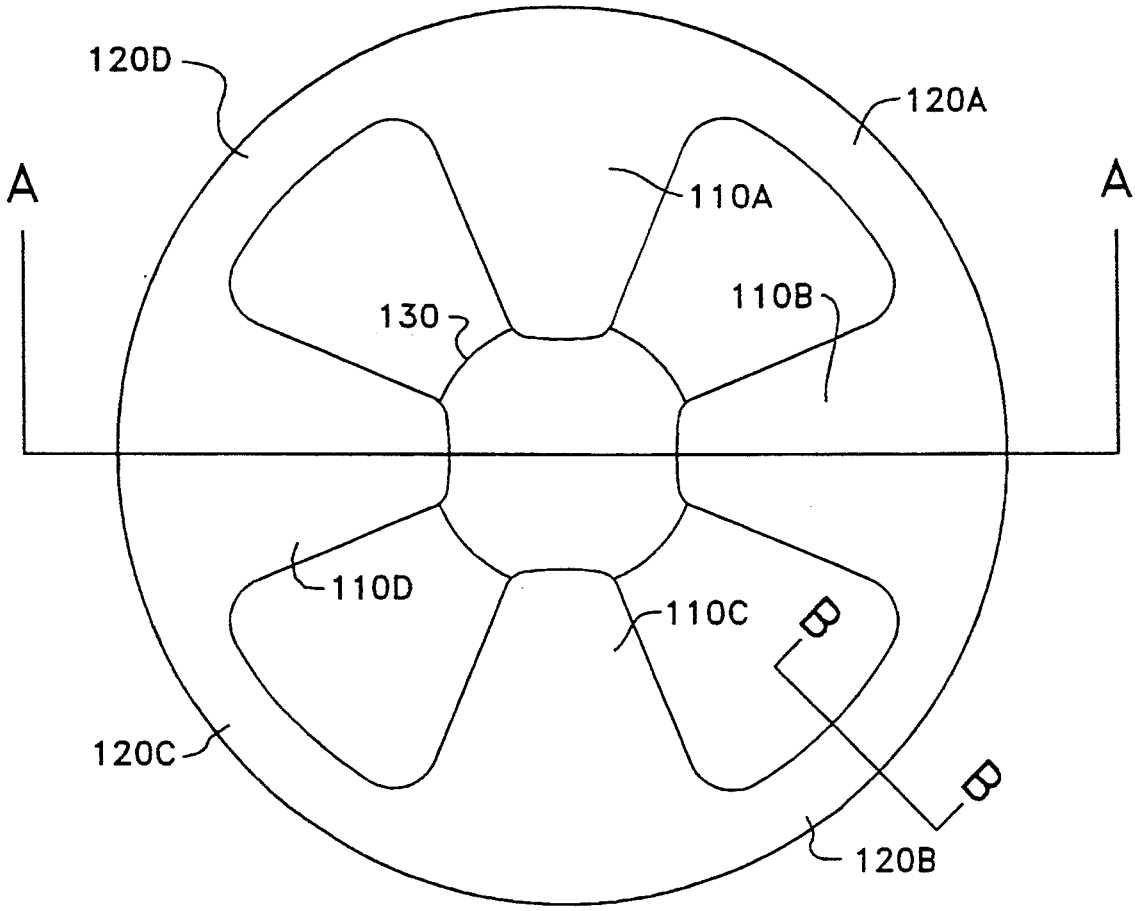
Figure 8
Figure 9B
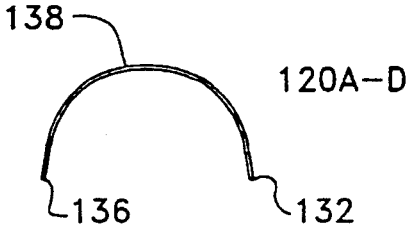

FLYING TOY

RELATED APPLICATION

This application is a continuation-in-part of U.S. patent application Ser. No. 07/210,832, filed Jun. 24, 1988 abandoned.

FIELD OF THE INVENTION

This invention relates to flying toys, and more particularly relates to flying disks which are thrown and return to the thrower.

BACKGROUND OF THE INVENTION

Flying toys which return to the thrower have been known for many years. Perhaps the most famous such flying toy is the modern form of the aboriginal boomerang, although the boomerang served the aborigines as far more than a toy.

The boomerang, however, can only be used in large, open spaces, and requires substantial skills on the part of the thrower before it will accurately return.

More recently, other flying toys which are intended to return to the thrower have been developed. One such flying toy, described as a circular boomerang, is shown is U.S. Pat. No. 4,337,950. Another flying toy, also described as a circular boomerang, is described in U.S. Pat. No. 4,479,655. Yet another circular boomerang is shown is U.S. Pat. No. 4,591,164. Still other flying toys are described in U.S. Pat. Nos. 3,082,572, 3,403,910, and 3,955,817. Each of these toys, while designed to fly and return to the thrower, met with varying degrees of success; none provided an ease of throwing combined with relatively reliable return necessary to a successful circular boomerang. Moreover, each of these devices requires a relatively large space in which to be thrown, and cannot be used successfully in a limited area.

Still other flying rings, not designed to return to the thrower, are shown in U.S. Pat. Nos. 4,560,358 and 4,063,382. Of course, the FRISBEE TM, a flying disk which does not return to the thrower under normal circumstances, is well known.

There has thus been a need for a flight toy capable of being thrown in a small area, and successfully returns to the thrower without significant training or skill.

SUMMARY OF THE INVENTION

The present invention solves many of the limitations of the prior art. The present invention comprises a specially shaped disk from which the center has been removed or, in some embodiments, in which the center has been positioned lower than the remainder of the disk to guide air flow and maintain a stable flight path. The remaining portion of the disk comprises a plurality of symmetrically spaced inward-pointing lobes, each of comprises an airfoil, with spaces therebetween. The lobes are connected at their outer edge by a plurality of arcuate segments, again preferably curved to perform at least somewhat as an airfoil. The resulting flight toy provides both leading edge, trailing edge, and rotational airfoils.

In at least some embodiments, the flight toy may be formed with an open bottom, such that the flight toy may be formed from a single sheet of material such as plastic. A plastic having high impact resistance and reasonable rigidity is preferred, such as ABS. Other plastics which offer light weight and structural rigidity will also work, although plastics which also can survive repeated ground impact offer the longest product life.

In use, the flying toy of the present invention is thrown very much like a FRISBEE TM. More specifically, the disk is typically thrown sidearm, with a rotational velocity imparted by a snap of the wrist. The disk is typically thrown with an inclination slightly above horizontal, although the exact angle of attack may be varied depending upon the specific embodiment and the environmental conditions, particularly wind. Depending on the embodiment of the present invention being used, wind may be a lesser or greater factor in the performance of the flight toy. The structural differences between the embodiments disclose primarily affect their performance in varying wind conditions, including still air.

Because of the shape of the disk and its rotational velocity, the aerodynamics involved cause the disk to increase in both altitude and angle of attack. Eventually, the increased angle of attack causes the disk to stall, at which time it begins its descent. The downward acceleration caused by gravity, together with the rotational velocity imparted by the thrower, will increase lift during the descent.

The increase in lift will typically lead to decreasing inclination. The increase in lift occurs at essentially the same rate as lift was lost initially, such that the disk returns substantially to the starting location, absent intervening winds or gross thrower error. The aerodynamic characteristics of certain embodiments cause them to perform better in still air to moderate winds, while others have aerodynamics which cause them to perform well in higher winds.

It is one object of the present invention to provide a flying toy which readily returns to the thrower.

It is a further object of the present invention to provide a flying toy which may be used in a confined space.

It is a further object of the present invention to provide a flying toy which may easily be used by a single player.

It is yet another object of the present invention to provide a flying toy which may be used by two or more players standing side by side.

It is a still further object of the present invention to provide a flight toy which can travel in a substantially vertical plane and return to the thrower.

There and other objects of the invention will be better understood from the following detailed description of the invention taken with reference to the attached Figures, in which FIG. 1 is a perspective view of the flying disk of the present invention, FIG. 2 is a top plan view of the flying disk of the present invention, FIG. 3 is a side elevational view of the flying disk of the present invention, FIG. 4 is a cross-sectional view taken along lines A—A of FIG. 2, FIG. 5 is a cross-sectional view taken along lines B—B of FIG. 2, and FIG. 6 is a cross-sectional view taken along lines C—C of FIG. 2.

FIG. 8 is a plan view of the embodiment shown in FIG. 7.

FIG. 9B is a cross-sectional view taken along lines B—B of FIG. 8.

DETAILED DESCRIPTION OF THE INVENTION

Figure 1:
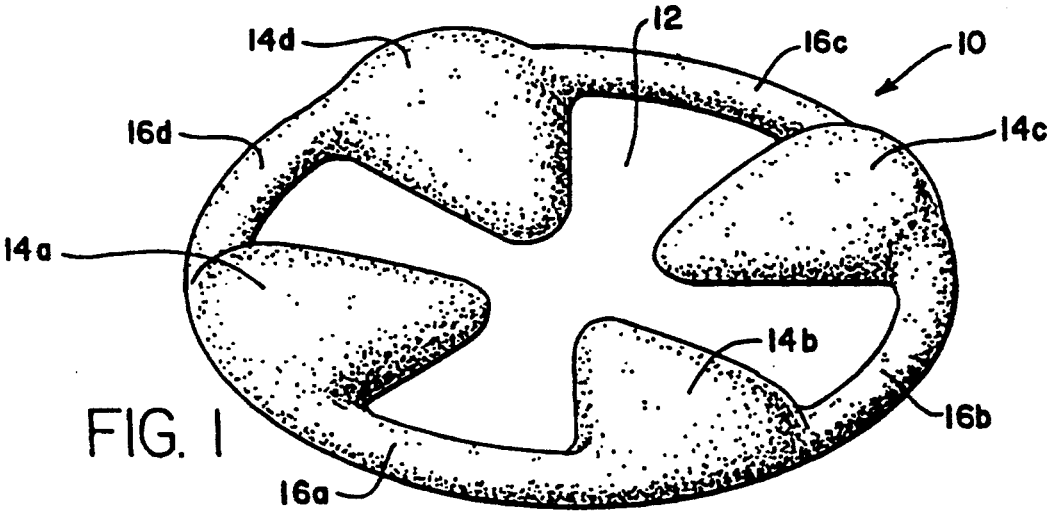
Figure 2:
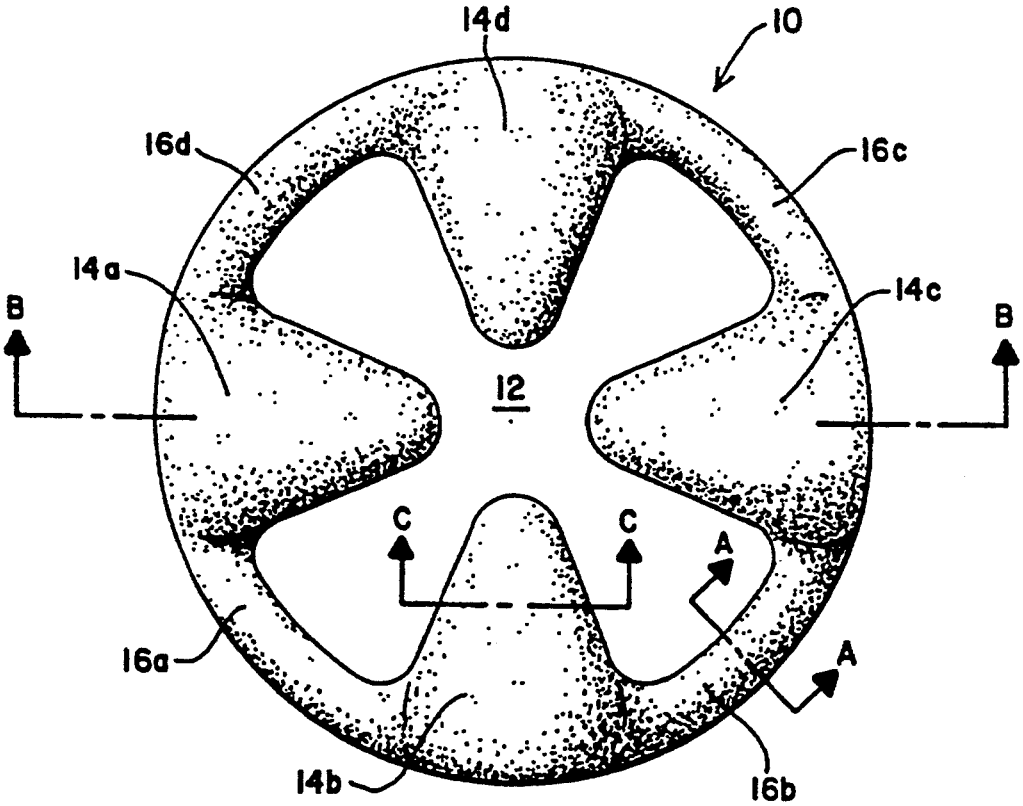

With reference to FIGS. 1 and 2, the aerodynamics of a first embodiment of the present invention may be better understood. More specifically, the first embodiment may be seen to comprise a disk 10 in which a generally cross-shaped center section 12 has been removed.

With the removal of the center section 12, the remainder of the disk 10 can be regarded as four inwardly protruding lobes or projections 14*a–d* connected at their outer edge or perimeter by four arcuate segments 16*a–d*, which alternatively may be regarded as cooperating with the outer edge of the lobes 14 to form a circumferential ring. It will be appreciated that the reduction of mass at the center of the disk 10 causes most of the mass to be located at the periphery of the disk, permitting a higher rotational moment to be created than for more conventional prior art designs which include significant mass at the center of the disk. The aperture at the center of this embodiment also appears to provide improved stability during flight, including improved linearity in the flight path. It is currently believed that the ability of the air to pass through the center of the toy during flight contributes to the increased aerodynamic stability of this embodiment, particularly at stall.

The disk 10 may be made of molded resilient tight cell foam or self-skinning foam. However, numerous other materials which provide sufficiently light weight and acceptable durability including impact resistance may also be used, including styrofoam, various plastics, and so on. Embodiments of the invention made from plastics will typically be formed from any of a variety of molding processes, and prototypes have successfully been vacuum formed from a single sheet of 0.040" thick plastic, although the thickness of the final product is less. Alternatively, injection or other molding techniques may be used. The plastic materials will preferably be high impact resistant types, such as ABS, expanded polyethylenes, high impact polystyrenes and so on, which can be formed from thin sheets and still retain significant impact resistance. In such embodiments, which are presently preferred because of their light weight, the underside of the disk 10 will be open or hollow.

Figure 3:
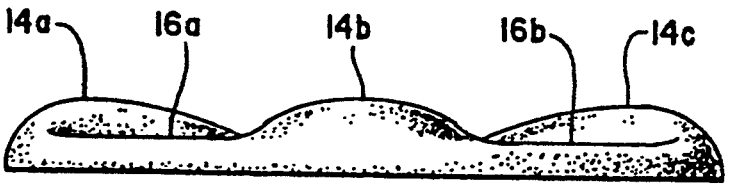

As may be seen generally from FIGS. 1 and 3, the shape of the first embodiment for the disk 10 comprises a complex airfoil which, when thrown with reasonable linear and rotational velocities such as with throwing a Frisbee, generates lift. More specifically, the bottom of the disk 10 is substantially flat when viewed from the edge, while the lobes 14*a–c* which may be viewed in FIG. 3 can be seen to comprise airfoils both rotationally (that is, from lobe to lobe) and radially (from circumference to center and vice versa). Likewise, the arcuate segments 16*a–d* or the circumferential ring formed by them may be seen to form a radial airfoil as well.

The rotational and radial airfoils may be better appreciated from FIGS. 4–6, which are cross-sectional views of various portions of the disk 10. FIG. 4, which is taken along section lines A—A of the disk 10, shows in cross-section the generally semi-circular shape of the peripheral arcuate segments 16*a–d*. Alternatively, and as can be seen more clearly from the other embodiments discussed below and shown in FIGS. 7–13, the cross-section may comprise substantially vertical inner and outer walls smoothly joined by an arcuate portion.

In contrast, the cross-section of the lobes 14*a–d*, taken along the midline as shown in FIG. 5, reveals that the lobes 14 are of a conventional airfoil shape with the leading edge of the airfoil being along the outer edge of the disk 10. It will be appreciated that the outer edge of the disk forms the leading edge of the airfoil because of the rotation of the disk during travel. It will further be appreciated that the peak of the airfoil as shown by FIG. 5 is preferably located approximately one-third of the length of the lobe from the outer edge, although numerous slight variations in location of the peak provide acceptable performance.

In contrast, the cross-section of the lobes 14*a–d* taken along the section line C—C can be seen in FIG. 6 to be symmetrical, to permit equal performance with rotation in either direction. The shape of the cross-section will, of course, vary depending on the distance from the end point at which the cross-section is taken.

It will also be appreciated that the lobes 14 and arcuate segments 16 are configured for a smooth transition therebetween, so that the entirety of the circumferential ring can be seen to be a complex curve transitioning between the airfoil of the lobes and the airfoil of the arcuate segments.

In use, the disk 10 is preferably thrown in a smooth sidearm motion ending with a snap of the wrist to impart a high rotational velocity. The disk 10 is preferably inclined slightly, for example on the order of 10–15', above the horizon when thrown, although the angle of inclination at the time of launch may be varied according to the desires of the user and wind conditions. For most angles of inclination at launch, the disk will continue to return to the thrower, although the height at which the disk returns may vary. Because of the relatively high rotational moment, the rotational velocity imparted to the disk by the thrower is maintained substantially throughout flight.

During flight, the rotating lobes 14 of the disk 10 perform as an airfoil with the leading edge of the airfoil being presented in the direction of flight. The resulting lift continuously increases the altitude of the disk, but also continuously increases its angle of attack, or inclination. Eventually the angle of attack will increase to the point that the disk will stall, although its rotation will continue.

When the disk stalls, it will be pulled downward by gravity, but the continuing rotation will continue to create lift along the leading edge of the disk, which is now nearest the thrower since that is the new direction of flight. As a result, the declination of the disk continuously decreases during the descent until the disk returns to the thrower at substantially the same angle as it was initially thrown. It will be appreciated that, throughout the flight, the path of the disk along the ground is substantially a straight line, although the altitude of the disk varies nonlinearly. Thus, the disk travels along a nonlinear curve in a substantially vertical plane. It is presently believed that the aperture formed at the center of the disk contributes to this linearity by allowing air to pass through the center during flight and at stall. Because the trajectory of the disk is substantially linear (along the ground) and the disk returns to the user, it can be seen that the flying toy of the present invention may be used by a single player, even in confined areas.

It will further be appreciated that the thrower may adjust for wind or other environmental elements by angling the disk into the wind on launch. Similarly, other players may participate by varying the levelness of the throw of the initial angle of attack at time of launch. Thus, multiple players standing substantially side by side can play with a single disk.

While the actual size of the flying toy of the present invention may vary over a wide range, a nominal overall diameter on the order of ten inches with a nominal height on the order of one inch has been shown to be successful.

Figure 10:
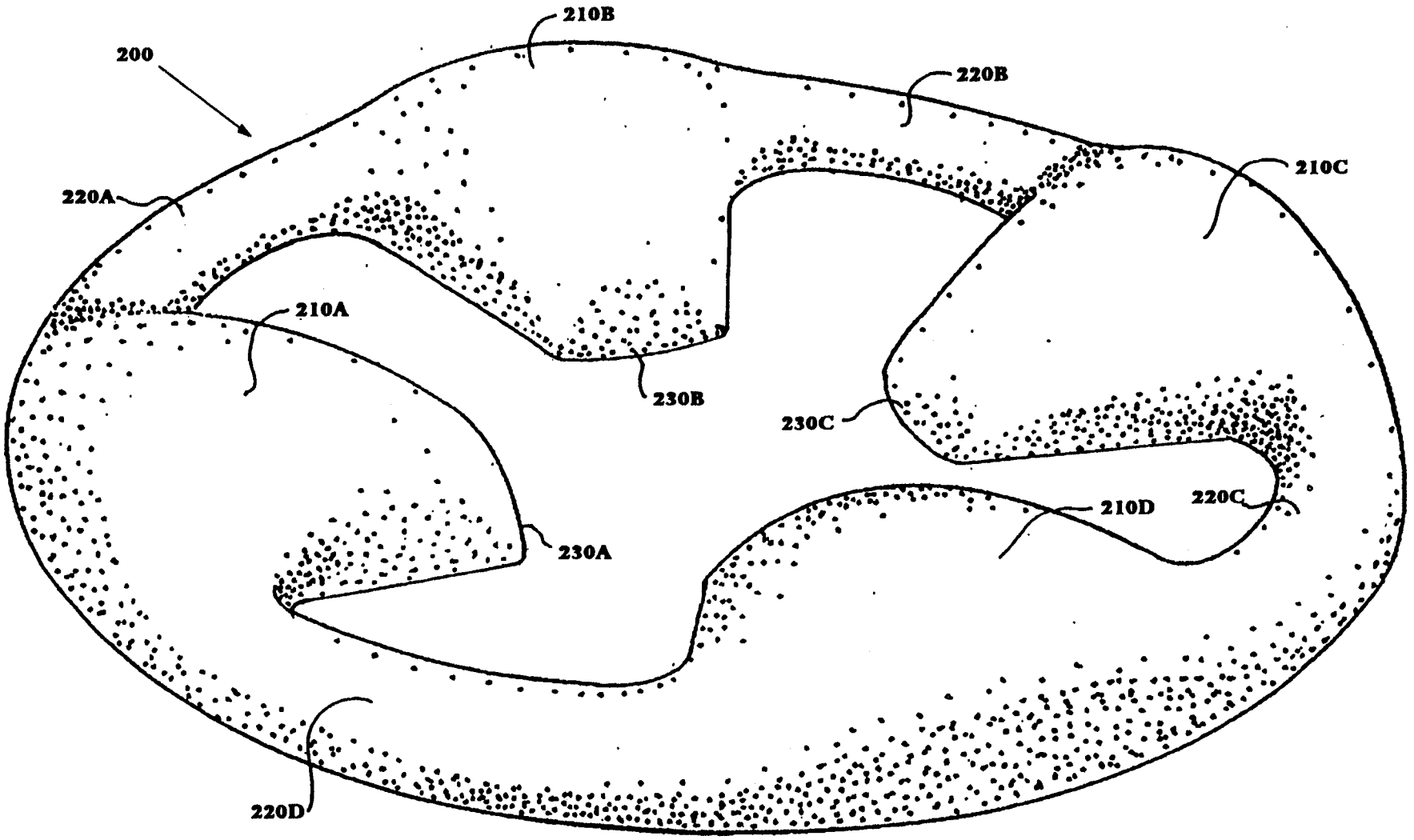
FIG. 10 is a perspective view of a third embodiment of the flight toy of the present invention, taken from above the elevational plane at the same angle as FIG. 7A.

The first embodiment has been found to be particularly successful when used in a headwind, but requires a greater attack angle on launch than may be desirable in other wind conditions, such as still air. In contrast, the second embodiment of the present invention, shown in FIGS. 7A–B through 10, provides an alternate design which, at present, is the most preferred embodiment for all environmental conditions, including still air, light winds, and high winds.

Figure 7A:
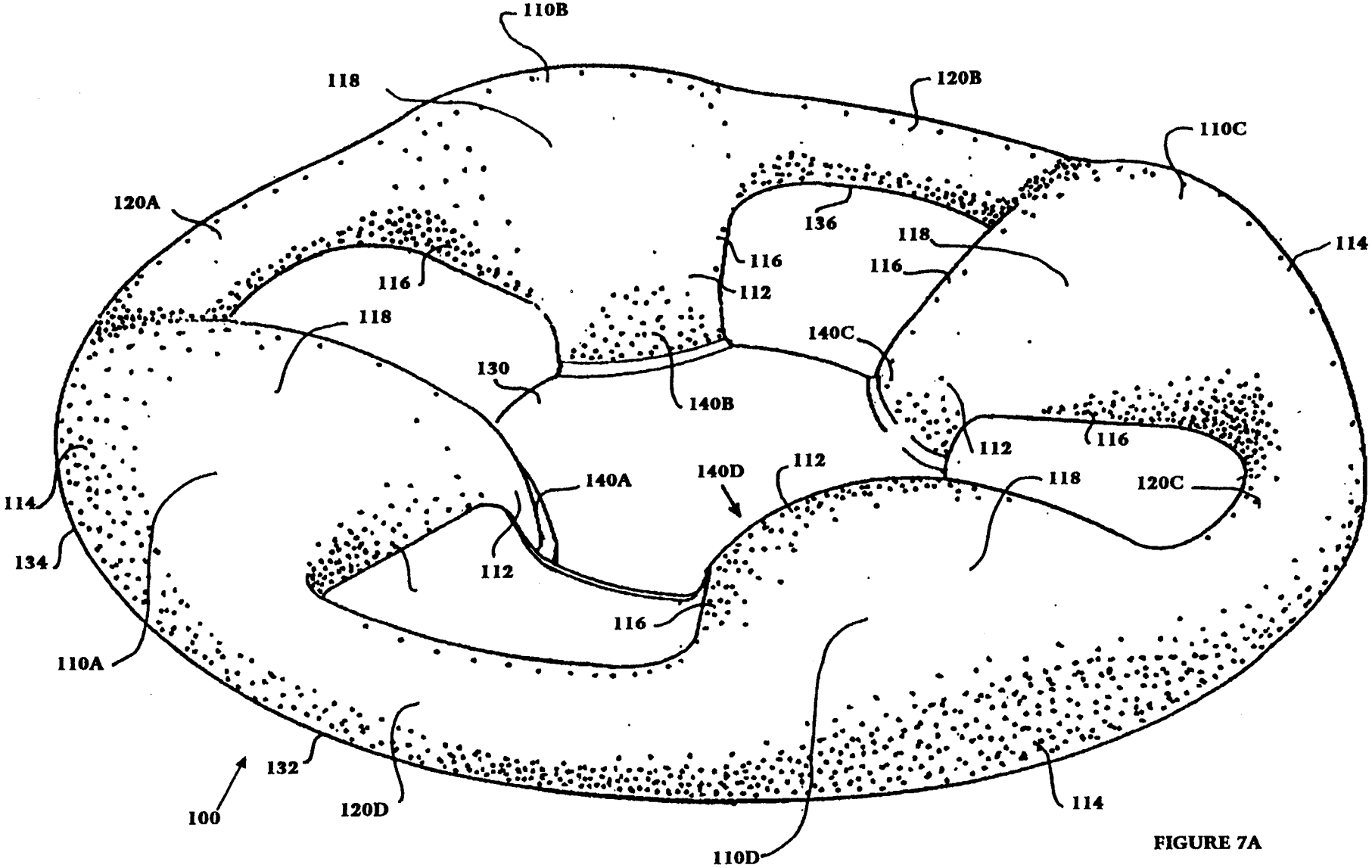
FIG. 7A is a perspective view of a second embodiment of the flight toy of the present invention taken from above the elevational plane.
Figure 7B:
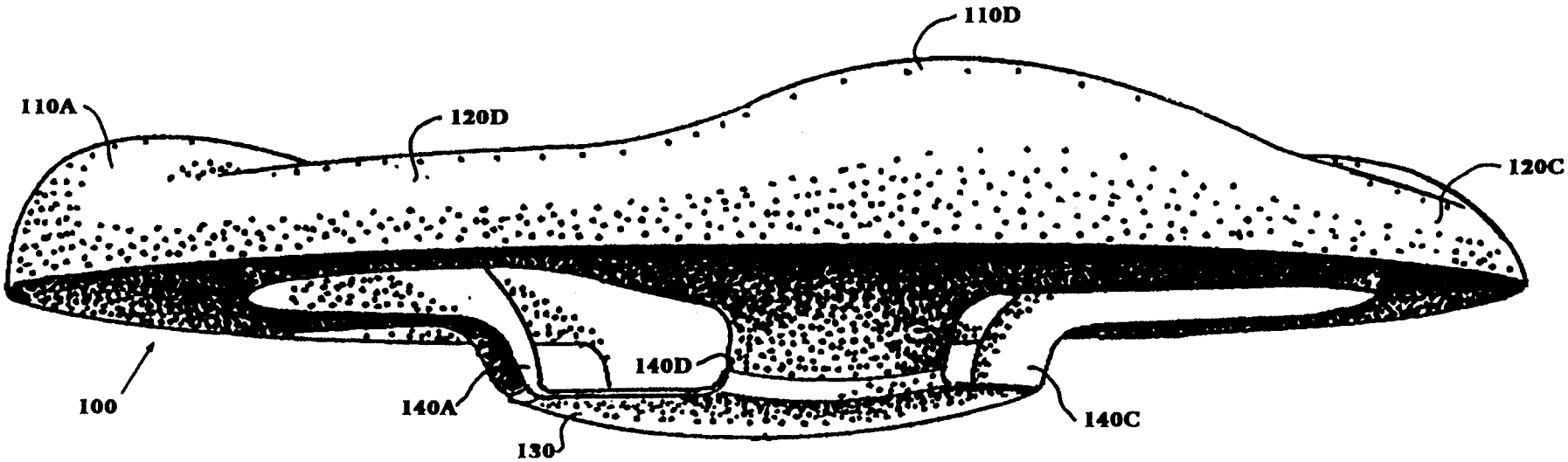
FIG. 7B is a perspective view of the flight toy of FIG. 7A taken from slightly below the elevational plane.

Referring first to FIG. 7A–B, which show in perspective view the second embodiment of the present invention, the flight toy 100 of the second embodiment can be seen to include four lobes 110A–D each having an inner surface 112, an outer surface 114, a pair of sides 116 and an upper surface 118. The outer surface of the lobes 110A–D are joined symmetrically at their outer edges by four arcuate segments 120A–D, all just as with the first embodiment. As with the first embodiment, the lobes 110A–D and arcuate segments 120A–D can be seen to be airfoils both during rotation and in the transverse or radial direction, and the arcuate segments and lobes may be thought of as cooperating to form a circumferential ring. In addition, each lobe is shown as rotationally symmetrical, although such symmetry is not required in all instances. However, altering such symmetry will typically change the flight characteristics of the flight toy, depending on whether the flight toy is thrown forehand or backhand. Likewise, in the exemplary embodiments shown herein, the lobes 110A–D all point to the center of the circumferential ring. Alternatively, the lobes 110A–D could point to other than the center; for example, the sides of the lobes 110A–D could form a portion of lesser chords of the circle defined by the circumferential ring, rather than a diameter.

Figure 9A:
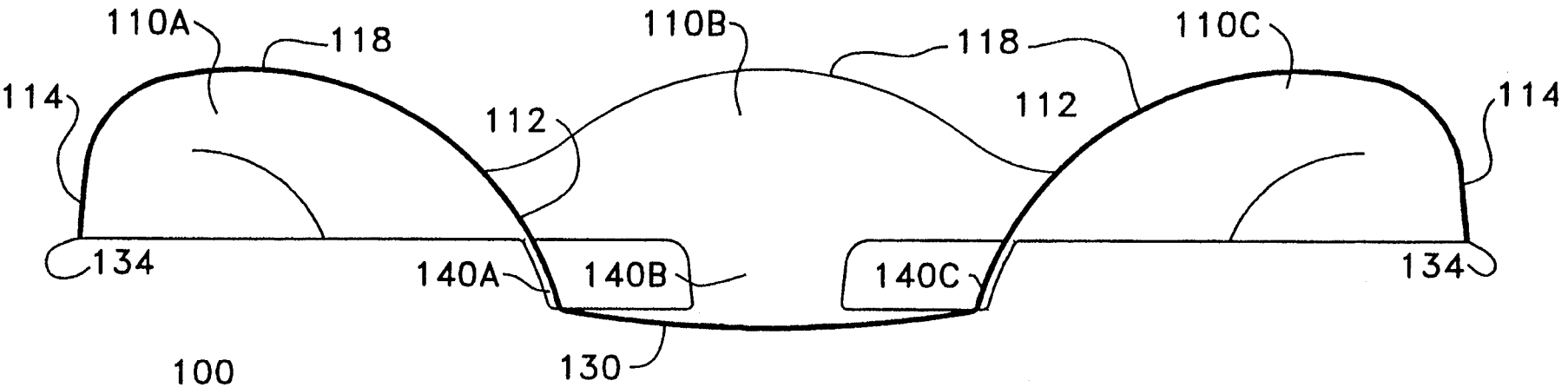
FIG. 9A is a cross-sectional side view taken along lines A—A of FIG. 8.

However, and as can be seen from FIGS. 7B and 9A–B particularly, the second embodiment differs from the first embodiment primarily in that a disk 130 is positioned at the center of the lobes 110A–D. The disk 130 is preferably concave. Importantly, the disk 130 is offset below the bottom edge of the lobes 110A–D. It is presently believed that this arrangement permits air under the disk 130 to be guided underneath the lobes 110A–D, which provides improved lift relative to the first embodiment. Because of this improved lift, the flight toy 100 can be thrown at a lower angle of attack, into less of a headwind, than the first embodiment and still return successfully to the user.

Referring to FIGS. 7A–B and FIG. 9A–B, it can also be appreciated that each lobe 110A–D is connected to the concave disk 130 by four attachment portions 140A–D which extend essentially vertically from the lobes 110A–D to the outer edge of the concave disk 130. It is presently preferred for the attachment portions 140 to continue the arcuate shape of the lobes, although this feature is not presently believed to be critical and other shapes for the attachment portions are likely to yield comparable performance. The concave shape of the disk 130 is presently preferred over other shapes, and presently is believed to give better performance than a flat disk, with a convex disk being the least functional. The concave disk appears to provide such improved performance because it directs air under the remainder of the flight toy, while still providing aerodynamic stability, allowing the disk to "rock" on an air cushion.

Referring particularly to FIGS. 9A and 9B, it can be appreciated that the lobes 110A–D on the second embodiment are somewhat shorter than the lobes 14A–D. While the precise length is not believed critical, a flight toy 100 vacuum formed from a single sheet of high impact styrene of 0.040" inch thickness having an outside diameter on the order of ten inches, four lobes approximately $3\frac{3}{4}$" in length, and a concave center disk having a diameter of $3\frac{7}{8}$" and a radius of curvature on the order of 6", has been found to fly well in still air and in wind. Using such a radius of curvature causes a tangent line at the edge of the disk 130 to also be tangent to the inside edge of the arcuate segments 120A–D. However, the radius of curvature of the disk 130 may vary over several inches to nearly infinity without significantly affecting performance, and a flat disk appears to be acceptable in at least some instances. The arcuate segments 120A–D are nominally on the order of one-half inch in height and $\frac{7}{8}$" in width, and have an outer edge 132 which integrally blends into the outer edge 134 of the lobes 110, thereby forming a circumferential ring as the outer edge of the flight toy. In cross-section, the outer edge 132 and inner edge 136 of the arcuate segments 120a–d each is substantially vertical and joined by a semicircular portion 138, although numerous rounded variations on this exemplary shape are believed workable. It will be appreciated that each of these shapes is substantially arcuate. While the arcuate segments 120A–D are shown as radially symmetrical in FIG. 9B, this is not required and an asymmetrical cross-section, with the peak nearer the outside edge, may be preferable in at least some embodiments. The lobes 110 are on the order of one inch high at the highest point. The lobes and the spaces therebetween typically, but not necessarily, are all of the same radial angle, although the edges of the lobes 110A–D are filleted both vertically and radially to provide a smooth transition to the semicircular portion 138 and inner edge 136 of the arcuate segments 120A–D when viewed both from plan view (FIG. 8) and a cross-sectional side view (FIG. 9A). The lower edge of the lobes 110 and segment 120 are preferably either flat or angled slightly downward from the outer edge to the attachment portions, such that the lower edges of the lobes define either a plane or an inverted cone. The disk 130 may typically be offset approximately one-half inch below the plane or cone defined by the lower edges of the lobes 110. The flight toy 100 is preferably although not necessarily open at the underside, to minimize weight, and can readily be vacuum formed from a single sheet of plastic. Alternatively, injection molding or other molding methods are acceptable and will generally be preferable for volume production. Depending on the weight of the material used, the flight toy may also be hollow rather than open at the bottom.

In a feature presently believed significant, the radial airfoil defined by each of the lobes 110 is radially asymmetric; that is, the outer edge rises toward the peak of the lobe at a much sharper angle than the inner edge. A prototype having an initial angle at its outer edge of between 80 degrees to 90 degrees, and an initial angle at its inner edge of between 20 degrees and 30 degrees, has been found to fly well. The outer edge of the lobe 110 may therefore be thought of as a blunt leading edge of the flying toy 100 while the inside edge of lobe 100 may be thought of as a tapered trailing edge. It is presently believed that radially symmetric airfoils of the sort generally found in the prior art do not generate sufficient lift to achieve stall and still return to their starting point.

Figure 11:
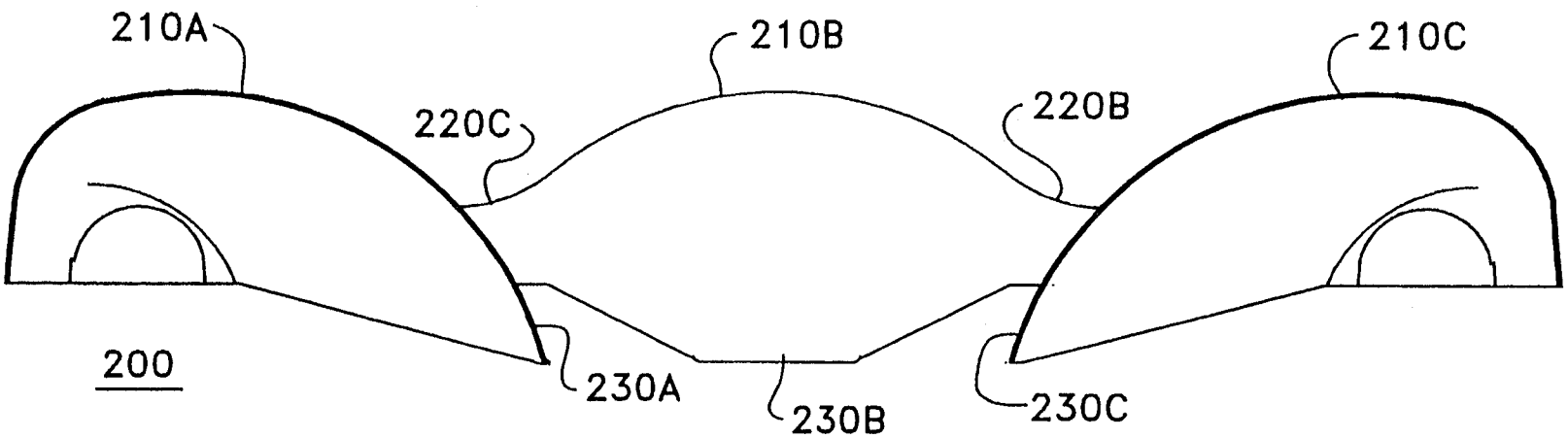
FIG. 11 is a cross-sectional side view of the embodiment shown in FIG. 10.

Referring next to FIGS. 10–11, a third embodiment of the present invention is shown. The flight toy 200 in the third embodiment is very similar to the second embodiment shown in FIGS. 7A–B to 9A–B, except that the disk 130 of the second embodiment has been removed. The lobes 210A–D of the third embodiment are of a length and contour substantially identical to the lobes of the second embodiment. Like the first and second embodiments, the lobes 210A–D are joined at their outer edge by arcuate segments 220A–D, which cooperate to form a circumferential ring. Like the second embodiment, the lobes 210 end at the inner edge with substantially vertical extensions 230A–D similar to the attachment portions 140A–D. Unlike the other embodiments, however, the lower edge of each of the lobes 210 preferably extends from the junction of the inner edge of the arcuate segment and the associated lobe in a straight line to the lower edge of the associated vertical extension 230 to provide best performance. Alternatively, a horizontal lower edge of the lobes 210 has been found to give slightly inferior but acceptable performance. In such an embodiment, the transition from the lower edge of the lobe 210 to the vertical extension 230 is essentially a sharp downward turn.

Having fully described one embodiment of the invention, it will be appreciated by those skilled in the art, given the teachings herein, that numerous alternatives and equivalents exist which do not depart from the invention. It is therefore intended that the invention not be limited by the foregoing detailed description, but instead only by the appended claims.

I claim:

1. A flying toy comprising a plurality of rotational airfoils having an outside edge and an inside edge, each of said airfoils being wider at its outside edge than at its inside edge and tapering from the outside edge to the inside edge, a plurality of arcuate segments extending between the outside edges of adjacent ones of the plurality of rotational airfoils, the arcuate segments being of a size to cause the inside edges of the rotational airfoils to be disposed apart from each other, a central disk disposed below the inside edges of the rotational airfoils, and a plurality of attachment portions, one attachment portion extending between the inside edge of one of the rotational airfoils and a portion of the central disk to cause the central disk to be fixedly connected to the rotational airfoils in a plane below the inside edges of the rotational airfoils, the rotational airfoils being configured as airfoils capable of providing lift both radially and rotationally.

2. The flying toy of claim 1 wherein the airfoils are hollow.

3. The flying toy of claim 2 wherein the rotational airfoils, arcuate segments, central disk and attachment portions are all integrally formed of molded plastic.

4. The flying toy of claim 3 wherein the central disk is concave when viewed from its top.

5. The flying toy of claim 3 wherein the number of rotational airfoils is four.

6. The flying toy of claim 1 wherein the rotational airfoils are open at their bottom.

7. A flying toy comprising a central disk, a plurality of attachment portions integrally formed with and extending substantially vertically from the central disk, a plurality of radial lobes, each radial lobe integrally formed with and extending radially outward from an associated one of the attachment portions, each radial lobe having a lower edge, an outer edge, and an inner edge, the inner edge forming a smooth transition between the associated attachment portion and the radial lobe, and the lower edges of each of the radial lobes defining one of either a plane or an inverted cone, and a plurality of arcuate portions, each arcuate portion integrally formed with and extending between the outer edges of an associated pair of radial lobes so that the plurality of arcuate portions and the plurality of radial lobes cooperate to define a circumferential ring, the radial lobes, arcuate portions and central disk all cooperating to generate radial and rotational lift when the flying toy is thrown with radial and rotational velocity such that the flying toy follows a path substantially within a vertical plane, stalls, and returns substantially to the starting point.

8. The flying toy of claim 7 wherein the radial lobes are radially asymmetrical, and wherein the peak of the radial lobes are substantially closer to the outer edge of the lobes than the inner edge.

9. The flying toy of claim 7 wherein the radial lobes have a blunt outer edge and a tapered inner edge.

10. A flying toy comprising a plurality of substantially vertical members, a plurality of radial lobes, each radial lobe integrally formed with and extending radially outward from an associated one of the substantially vertical members, each radial lobe having a lower edge, a blunt outer edge, and a tapered inner edge, the inner edge forming a smooth transition between the associated substantially vertical member and the radial lobe, and the lower edges of each of the radial lobes defining one of either a plane or an Inverted cone, and a plurality of arcuate portions, each arcuate portion integrally formed with and extending between the outer edges of an associated pair of radial lobes so that the plurality of arcuate portions and the plurality of radial lobes cooperate to define a circumferential ring which provides lift when thrown with a rotational velocity.

11. A flying toy comprising a plurality of arcuate segments having a substantially arcuate cross-section, the arcuate segments each having an outer portion with a outer bottom edge and an inner portion with inner bottom edge, a plurality of radial airfoils each having an outer surface and an inner surface, the outer surfaces thereof being symmetrically disposed between and formed integrally with the outer portion of the adjacent arcuate segments, and the inner surfaces thereof projecting generally inward, the inner surfaces of the airfoils each being disposed apart from one another to create an aperture therebetween, a plurality of substantially vertical attachment portions, each attachment portion being integrally formed with the inner surface of an associated one of the radial airfoils and extending below such inner surface, and a substantially circular disk integrally formed with the plurality of attachment portions, the attachment portions each being connected to the disk substantially at the edge thereof.

12. The invention of claim 11 wherein the radial airfoils point toward the center of a circle defined by the outer surfaces of the radial airfoils and the arcuate segments.

13. The invention of claim 11 wherein each of the radial airfoils has a lower edge, and the lower edges of the radial airfoils define one of a group comprised of a plane and an inverted cone.

* * * * *